United States Patent [19]

Ulm

[11] Patent Number: 4,711,380

[45] Date of Patent: Dec. 8, 1987

[54] TAMPER-EVIDENT SEAL FOR A TOGGLE-TYPE DISPENSING VALVE

[75] Inventor: John G. Ulm, Upper Sandusky, Ohio

[73] Assignee: Liqui-Box Corporation, Worthington, Ohio

[21] Appl. No.: 897,464

[22] Filed: Aug. 18, 1986

[51] Int. Cl.[4] ..... B65D 47/10

[52] U.S. Cl. ..... 222/541; 222/511

[58] Field of Search ..... 222/511, 498, 517, 541, 222/153, 505; 251/280

[56] References Cited

U.S. PATENT DOCUMENTS

| | | | |
|---|---|---|---|
| 3,278,089 | 10/1966 | Heekin et al. | 222/541 |
| 3,400,866 | 10/1968 | Fattori | 222/511 |
| 3,443,728 | 5/1969 | Scholle | 222/511 |
| 3,493,146 | 2/1970 | Conners et al. | 222/153 |
| 3,972,452 | 8/1976 | Welsh | 222/501 |
| 4,169,548 | 10/1979 | Bond | 222/505 |
| 4,386,720 | 6/1983 | Speedie | 222/541 |
| 4,444,340 | 4/1984 | Bond et al. | 222/498 |
| 4,478,242 | 10/1984 | Bond | 137/242 |

FOREIGN PATENT DOCUMENTS

| | | | |
|---|---|---|---|
| 2307714 | 12/1976 | France | 222/541 |

*Primary Examiner*—F. J. Bartuska
*Assistant Examiner*—Kenneth Noland
*Attorney, Agent, or Firm*—William V. Miller; Sidney W. Millard

[57] ABSTRACT

A tear-off tab structure applicable to a self-closing dispensing valve structure of the toggle type mounted on a spout in which passage to the outlet is normally-closed by an axially inwardly-extending flexible wall structure that can be flexed by a toggle lever carried thereby to complete a discharge passage to the outlet. The tear-off tab structure substantially covers the outlet and to give access to the spout through the outlet the tab structure must be disturbed thereby giving evidence of tampering.

7 Claims, 6 Drawing Figures

TAMPER-EVIDENT SEAL FOR A TOGGLE-TYPE DISPENSING VALVE

BACKGROUND OF THE INVENTION

This invention relates to a dispensing valve of the automatically-sealing or self-closing type mounted on the cooperating spout of a container for liquids or other substances.

It relates more specifically to the type of dispensing valve known in the prior art as a toggle valve, a good example of which is illustrated in the U.S. Pat. No. No. 4,444,340 to Bond et al. which shows it applied to a flexible bag. This valve has an outer wall which engages the spout and which has an outlet beyond the outer end of the spout. It also has a resiliently flexible wall structure which normally engages the spout to seal the outlet. However, a toggle lever is connected to the flexible wall structure so that a portion therof can be flexed away from the spout to open a passage to the dispensing outlet. With this type of valve non-evident tampering with the contents of the container which carries it can occur readily merely by pressing on the toggle to open the outlet and inserting or passing some contaminant through the opened outlet into the container. There is a need for a sealing means which will readily indicate any tampering of the valve to open the outlet in an attempt to add anything to the container contents through the outlet.

SUMMARY OF THE INVENTION

The present invention will be described with specific reference to the type of toggle valve illustrated in U.S. Pat. No. 4,444,340 applied to a flexible bag, but it will be understood that it is applicable to any type of prior art toggle-operated valve applied to various types of containers and which includes a resiliently-flexible sealing wall or diaphragm normally closing a dispensing outlet passage but movable by the toggle to flex and thereby to open the passage. This means comprises a tear-off sealing tab which has an outlet-covering wall section and an extension to be engaged by the fingers to tear away the wall section to expose the outlet. As long as the tear-off tab is in place the valve cannot be operated normally to open the outlet, but if the tab is torn off by pulling it from covering relationship to the outlet, there is evidence of tampering.

BRIEF DESCRIPTION OF THE DRAWINGS

The best mode contemplated in carrying out this invention is illustrated in the accompanying drawings in which.

DETAILED DESCRIPTION OF THE INVENTION

Figure 3:
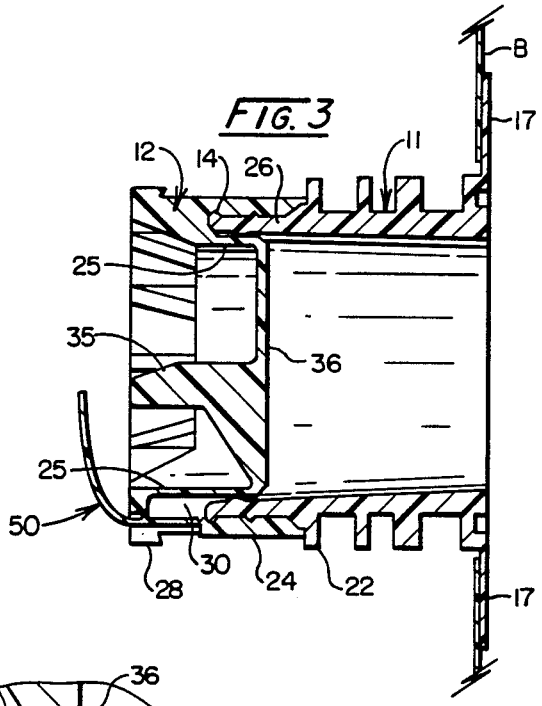
FIG. 3 is a transverse sectional view taken on line 3—3 of FIG. 2.
Figure 6:
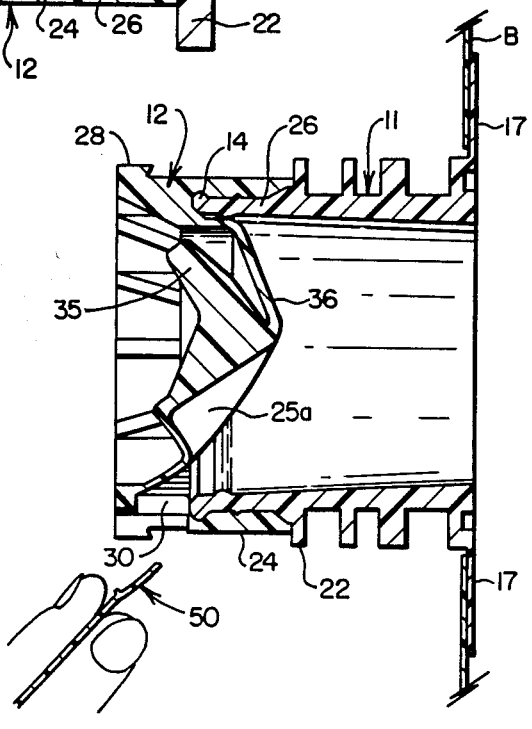
FIG. 6 is a view similar to FIG. 3 but showing the sealing tab removed.

With specific reference to the drawings, the valve of this invention is shown applied to a flexible plastic bag of the type of package known generally as bag-in-box and illustrated at B in FIGS. 3 and 6. However, the valve of this invention can be applied to any of a number of different types of containers, for example, the type of blown plastic container shown in U.S. Pat. No. 4,478,242.

The assembly in which this invention is shown embodied comprises a spout indicated generally by the numeral 11 and a valve indicated generally by the numeral 12. The spout is made of the usual semi-rigid plastic material. The valve is made of the usual elastomeric or resiliently flexible plastic material. In the drawings, the present invention is shown applied to the structure illustrated in U.S. Pat. No. 4,444,340 which includes the spout 11 of annular tubular form with an outer lip 14. At its inner end the spout has an annular peripheral relatively flexible continuous attaching flange 17 which is used to attach it to the flexible bag B to which it is heat-sealed as indicated in FIGS. 3 and 6. An outermost flange 22 is provided on the spout which is spaced axially-inwardly a predetermined distance from the lip 14 to serve as a stop for aiding in positioning the valve 12 on the spout. A continuous annular sealing rib 20 is formed on the interior surface of the spout 11 at a definite axial position inwardly of the lip 14. This position is axially intermediate the lip 14 and the flange 22. The attaching flange 17 will be relatively thin and flexible whereas the remainder of the spout will be heavier and, consequently, semi-rigid. As indicated in said patent the valve 12 is made of plastic material which is elastomeric or resiliently flexible so that it can be distorted under pressure but will return to its original position when pressure is released.

Figure 1:
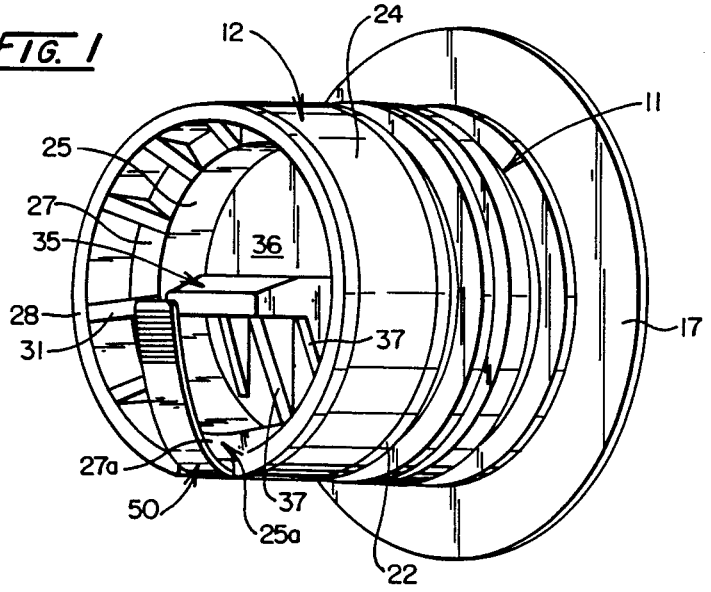
FIG. 1 is a perspective view of a toggle-view dispensing valve provided with the tear-off tamper-evident sealing tab of this invention, the valve being shown mounted on a spout.
Figure 2:
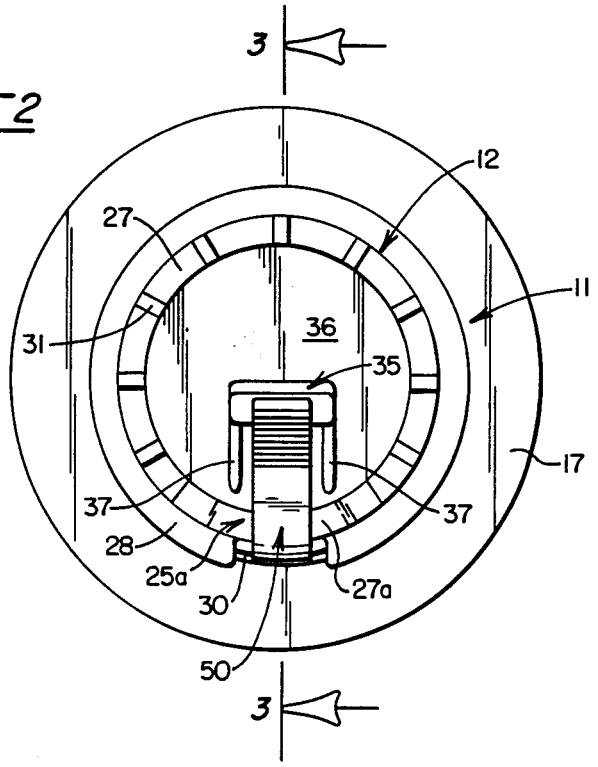
FIG. 2 is a plan view of the assembly of FIG. 1.
Figure 4:
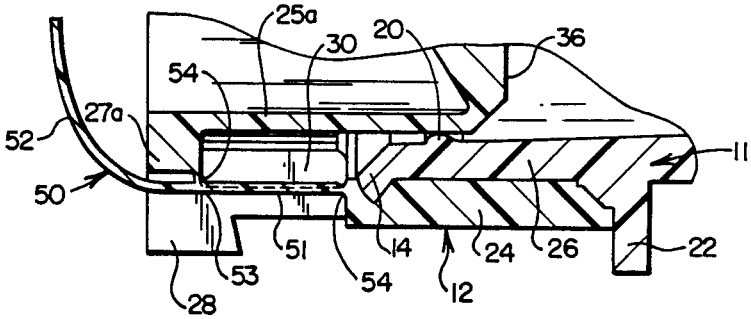
FIG. 4 is an enlarged sectional view of the valve of FIG. 3 showing in more detail the sealing tab in position at the outlet.

As disclosed in said patent, the valve member 12 comprises spaced, hollow, cylindrical and coaxial inner and outer walls 25 and 24 respectively. The walls 24 and 25 are interconnected by a transverse flange 27 (FIG. 1) but are spaced apart sufficiently to provide an axially-inwardly-open socket 26 (FIG. 4) capable of receiving and engaging the axially-outward end portion of the spout 11. The outer wall 24 is of greater axial extent than the inner wall 25, the transverse flange 27 connecting the axially-outward end of the inner wall 25 to an axially-intermediate portion of the outer wall 24. The extreme outward end of the outer wall 24 carries an outwardly-extending reinforcing bead 28, and the portion of the outer wall 24 lying axially outwardly of the flange 27 is reinforced by spaced gussets 31 extending between the axially-outward end of the outer wall 24 and flange 27. The axially-inward end of the inner wall 25 is attached to a transverse wall 36, which closes the axially-inward end of the inner wall 25, the transverse wall 36 lying perpendicular to the axis of the cylindrical inner wall 25 so that they are connected together at right angles. The central portion of the transverse wall 36 carries a distorting member in the form of a toggle lever 35, which extends axially outwardly from the wall 36, to which it is connected by triangular gussets 37 directed vertically downwardly (with the valve assembly in the orientation shown in the drawings, which is its normal operating orientation). The valve member 12 is pushed onto the axially-outward end of the spout 11 so that the axially-outward end of the spout 11 enters the socket 26 of the valve member 12. The spout and the valve member are retained in their correct axial positions relative to one another with the sealing rib 20 on the inner surface of the spout sealing against the outer surface of the inner wall 25, the axial length of the inner wall being sufficient to dispose the transverse wall 36 inwardly well beyond the rib 20 on the spout once insertion of the spout into the socket 26 has thus been completed. The rib 20 on the spout is so sized that its internal diameter is slightly less than the external diameter of the inner wall 25 so that during insertion of the spout 11 into the socket 26 the rib 20 is compressed and forms a tight frictional seal with the inner wall 25.

As disclosed in said patent, a dispensing outlet 30 is provided on the lowest part of the valve assembly (when the valve assembly is in its normal working orientation as shown). This dispensing outlet 30 is provided by forming a cut-out in the flange 27, and adjacent this cut-out in the flange 27 is a similar cut-out in the head 28 on the outer wall 24. Also adjacent the cut-out in the flange 27, the inner wall 25 carries an extension 25*a* which extends axially-outwardly to the plane of the axially-outward face of the bead 28. The axially-outward edge of the main portion of the extension is joined to the bead 28 by a flange 27*a* which forms, in effect, a continuation of the bead 28.

When the valve member 12 is in its natural, undistorted configuration, the passage through the spout 11 is sealed by the axially-inwardly extending flexible wall structure consisting of transverse wall 36 and inner wall 25 which engages the rib 20 on the spout. To open the valve assembly, the lever 35 is pushed upwardly and axially-inwardly, and because of the downwardly-extending gussets 37, this upward and axially-inward movement of the lever 35 causes the portion of the transverse wall 36 adjacent the extension 25*a* to be distorted axially-outwardly, as shown in FIG. 6, thereby causing the extension 25*a* to be pulled inwardly. The major portion of the inner wall 25 cannot move inwardly since it is constrained by its connection to the transverse flange 27 adjacent the extension 25*a*, leaving the extension 25*a* free to distort inwardly. This inward movement of the extension 25*a* opens a dispensing passage (as best seen in FIG. 6) connecting the passage through the spout 11 to the dispensing outlet 30, this dispensing outlet being bounded by the inner wall 25, the inner surface of the spout 11, the extension 25*a* and the axially-outward portion of the outer wall 24 lying axially outwardly of the lip 14 of the spout 11.

Because of the right-angled connection between the transverse wall 36 and the inner wall 25, when the toggle lever 35 is released, the transverse wall 36 and the inner wall 25, including the extension 25*a* will quickly snap back into their closed position, as shown in FIG. 3, thereby restoring the seal between the rib 20 and the spout 11 and the inner wall 25.

It will thus be apparent that the patented structure so far described provides a plug-like valve structure which fits into the spout 11, this structure comprising the plug formed by the flexible axially-inwardly extending wall structure including the inner annular wall 25 and the flexible transverse wall 36. The wall 25 is normally in sealing engagement with the annular rib 20 on the inner surface of the spout but when the valve is actuated by the toggle 35 an outlet passage is created to the outlet 30. At any time with this patented structure the valve could be opened so that contaminants could be passed through the outlet 30 into the contents of the container without evidence.

To prevent this, according to this present invention, a tear-off tab structure 50 is provided for covering the outlet 30 as shown in the drawings. This structure is such that normally it is disposed in covering relationship to the outlet and must be removed before the valve can operate in a normal manner to dispense the container contents. The only way access to the contents of the container can be obtained is to first remove the tear-off tab 50 from the outlet, thus indicating to a subsequent user that a tampering with the valve has occured.

Figure 5:
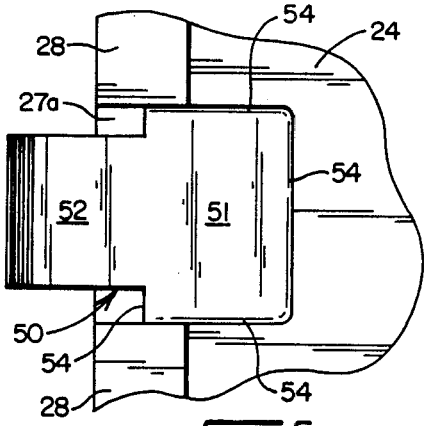
FIG. 5 is a face view of the sealing tab in position at the outlet.

This tear-off tab 50 is shown applied to the outlet 30 in all Figures of the drawings. It is shown best in enlarged detail in FIGS. 4 and 5 and comprises an inner main outlet-covering section 51 of substantially rectangular form and an outer reduced width pull-tab extension section 52 which can be engaged by the fingers in tearing off the tab to expose the outlet. The pull tab section 52 is of less width than the covering section 51 being connected thereto at an angle joint 53 and curving outwardly of the plane of the section 51 and over the toggle 35 so that it can be readily gripped by the fingers. Its surfaces can be knurled to facilitate gripping.

As previously indicated the outlet 30 (FIGS. 4 and 5) is formed in the wall extension 25*a* inwardly of the outer flange 27*a* and outwardly of the outer lip 14 of the spout 11 and as shown is of rectangular form. The covering section 51 of the tear-off tab 50 is of similar shape and size and in forming the valve 12 is joined to the edges of the outlet by weakened tear lines 54 formed by thinning the material of section 51 at the flange 27*a*, the extension 25*a* and adjacent edge of wall 24. These tear lines provide joints that are weaker than the rest of the tab material so that a pull on the pull-tab section 52 will tear the outlet-covering section 51 away from the outlet 30 at all the lines 54. However, even if the section 51 is not torn off the outlet 30 completely to the condition indicated in FIG. 6 there will be an indication that tampering has occured since its connection at the outlet will be disturbed even if it is torn-off just enough to admit a foreign substance through the outlet. The outlet-covering section 51 will normally completely seal the outlet 30 and prevent dispensing even if the toggle lever 35 is activated but this is not essential as long as it substantially covers the outlet and must be removed to gain access to the outlet.

It is preferred that after the container is filled with its desired contents, the valve 12 be fixed on the spout 11 in some manner so that the complete valve cannot be removed without damage to the valve and/or spout. One simple way this can be accomplished is to apply an adhesive between the valve and spout to permanently connect the members. Another way is to have an interlocking structure between the valve and spout which is common in the art and which would prevent separation of these members without some evidence of damage.

It will thus be apparent that this invention provides a tear-off tab structure cooperating with the outlet of a toggle-type dispensing valve to indicate tampering at the outlet prior to the use of the valve for normal dispensing. The tear-off tab is applicable to the valve disclosed in said patent as well as other prior art toggle valves where there is an axially inwardly extending flexible concave wall structure, either in the form of a plug or concave diaphragm, which normally seals by contact with the spout to prevent connection to the outlet, but which can be flexed by the toggle to create a passage from the spout to the outlet.

I claim:

1. A dispensing valve and spout assembly comprising: a hollow tubular spout having axially inner and outer ends, a valve member formed of resiliently flexible material mounted on the outer end of the spout, said valve member having spaced, hollow tubular concentric inner and outer walls, the inner and outer walls being flexible and interconnected but spaced apart sufficiently to provide a socket, said socket receiving and engaging the outer end of the spout, part of the inner wall carrying a flexible hollow extension with an outlet, the inner wall carrying adjacent its axially-inward end a transverse wall, means on the spout for forming a first seal with the inner wall of the valve member, said outer wall having an outlet positioned axially outwardly beyond the axially outer end of the spout which said outlet of said outer wall is directed radially outwardly from the axial outer end of the spout, the hollow flexible extension projecting axially outwardlly beyond the axially outer end of the spout and the hollow flexible extension is connected to the outer wall at a closed upper outer end where the outlet of the flexible hollow extension is located and is directed radially outwardly towards the outlet in the outer wall with which it substantially aligns, a distorting member mounted on the transverse wall such that movement of the distorting member in one direction will cause flexing of both the transverse wall and the inner wall as well as said extension, thereby opening a dispensing passage to said outlet in the outer wall bounded by the inner wall, the spout and the extension of the inner wall, means forming a combination of an anti-tampering structure and a second seal between the valve member and the spout comprising a tear-off tab sealed in said outlet in the flexible extension to normally prevent access through that outlet into the spout and seal it to prevent leakage therethrough in case of failure at the first seal means said tear-off tab comprising an outlet covering section secured by a tear line connection to the closed upper, outer end of said extension and extending axially along the extension to which it is secured and then to the adjacent outer wall to which it is secured.

2. An assembly according to claim 1 in which the tear-off tab has a main covering section secured to the outlet by tear lines.

3. An assembly according to claim 2 in which the main section has an outwardly-extending finger gripping section.

4. An assembly according to claim 3 in which the finger-gripping section curves outwardly and then inwardly towards the distorting member.

5. An assembly according to claim 1 in which the spout is cemented in the socket.

6. The combination of claim 9 in which the valve is fixed on the spout.

7. An assembly according to claim 1 in which an annular sealing rib is carried by the spout, said rib being spaced from its axially-outwardly end so that when the spout end is inserted into the socket, the rib will sealingly engage the inner wall thereby forming the first seal means.

* * * * *